US005529083A

United States Patent [19]

Martin

[11] Patent Number: 5,529,083

[45] Date of Patent: Jun. 25, 1996

[54] CLAMP ASSEMBLY FOR UMBRELLA TARP

[75] Inventor: Leo Martin, Coconut Grove, Fla.

[73] Assignee: Miami Metal Products, Inc., Miami, Fla.

[21] Appl. No.: 438,994

[22] Filed: May 11, 1995

[51] Int. Cl.[6] ..... A45B 25/00

[52] U.S. Cl. ..... 135/31; 135/33.5

[58] Field of Search ..... 135/33.5, 31; 52/713, 52/716.3, 716.4; 24/11 HC, 3.1, 543, 482

[56] References Cited

U.S. PATENT DOCUMENTS

| | | | |
|---|---|---|---|
| 2,185,587 | 1/1940 | Carlisle | 135/33.5 |
| 2,591,095 | 4/1952 | Ornstein et al. | 135/33.5 |
| 2,784,727 | 3/1957 | Fleischer | 135/33.5 |
| 3,982,307 | 9/1976 | Smith et al. | 24/543 |
| 4,212,303 | 7/1980 | Nolan | 24/543 X |
| 5,337,987 | 8/1994 | Sawatsky | 24/543 X |
| 5,367,750 | 11/1994 | Ward | 24/543 X |
| 5,468,087 | 11/1995 | Tung | 135/33.5 X |

*Primary Examiner*—Lanna Mai

[57] ABSTRACT

A clamp assembly for an umbrella tarp as applied on an umbrella frame comprises a two piece end cap and jaw assembly. A first, top section is comprised of a beam having a laterally extending flange therefrom. On the underside of the flange is a series of ribs or teeth forming the top half of the jaw assembly. Also extending laterally from the beam, and below the flange, are a pair of flanges that can be fit within the end of an extension member of an umbrella, forming an end cap. A second, bottom section has corresponding ribs to interconnectedly mate with the ribs of the top section. The bottom section has itself a bottom which conforms to the shape of the extension member of an umbrella frame. The umbrella tarp is placed between the first and section sections and the assembly is secured by screws or rivets into the umbrella frame's extension member.

4 Claims, 2 Drawing Sheets

CLAMP ASSEMBLY FOR UMBRELLA TARP

FIELD OF THE INVENTION

The present invention relates to a clamp assembly for an umbrella tarp. More particularly, the present invention provides for a two piece end cap and jaw clamp assembly for an umbrella tarp.

BACKGROUND OF THE INVENTION

For umbrellas, and particularly standing umbrellas, the umbrella tarp of course needs to be secured to the umbrella frame. The umbrella frame will typically have extension members to permit the umbrella, when open, to provide shade from its tarp. The extension members may be described as having a proximal end at or near the umbrella pole and a distal end at the end opposite that of the proximal end. The distal end needs to be able to attach to the tarp to secure it into place.

One method for securing the tarp to the distal end of an umbrella's extension members is to form a pocket from the tarp. The extension member is then fitted within the pocket thus securing the tarp to the umbrella frame. However, this method has a disadvantage in that from continuous use of opening and closing the umbrella, the extension members tend to cause a hole in the tarp pocket. The result is that the tarp is no longer secured to the umbrella frame. In addition, this method of securing the tarp to the umbrella frame is unattractive. Aesthetic appeal is oftentimes important for this type of commodity as it is used for, among other reasons, coordinated decoration of a home, office or hotel, etc.

SUMMARY OF THE INVENTION

The present invention overcomes the disadvantages of the prior art by providing a clamp assembly for an umbrella tarp as applied on an umbrella frame. The clamp comprises a two piece end cap and jaw assembly. A first, top section is comprised of a beam having a laterally extending flange therefrom. On the underside of the flange is a series of ribs or teeth forming the top half of the jaw assembly. Also extending laterally from the beam, and below the flange, are a pair of flanges that can be fit within the end of an extension member of an umbrella, forming an end cap. A second, bottom section has corresponding ribs to interconnectedly mate with the ribs of the top section. The bottom section has itself a bottom which conforms to the shape of the extension member of an umbrella frame. The umbrella tarp is placed between the first and section sections and the assembly is secured by screws or rivets into the umbrella frame's extension member.

It is therefore an object of the present invention to provide an end cap to the extension member of an umbrella, preferably, a standing umbrella.

It is another object of the present invention to provide for a device to clamp an umbrella tarp to the distal end of an umbrella frame's extension member.

It is still another object of the present invention to eliminate tearing of an umbrella tarp previously caused by inserting an umbrella extension member into a folded pocket of the tarp meant to secure the said tarp to the umbrella frame.

Further objects and advantages of this invention will be apparent from the description and claims which follow.

BRIEF DESCRIPTION OF THE DRAWINGS

The features embodying the present invention are illustrated in the accompanying drawing, forming a part of this application, in which.

DETAILED DESCRIPTION OF THE PREFERRED EMBODIMENT

Figure 8:
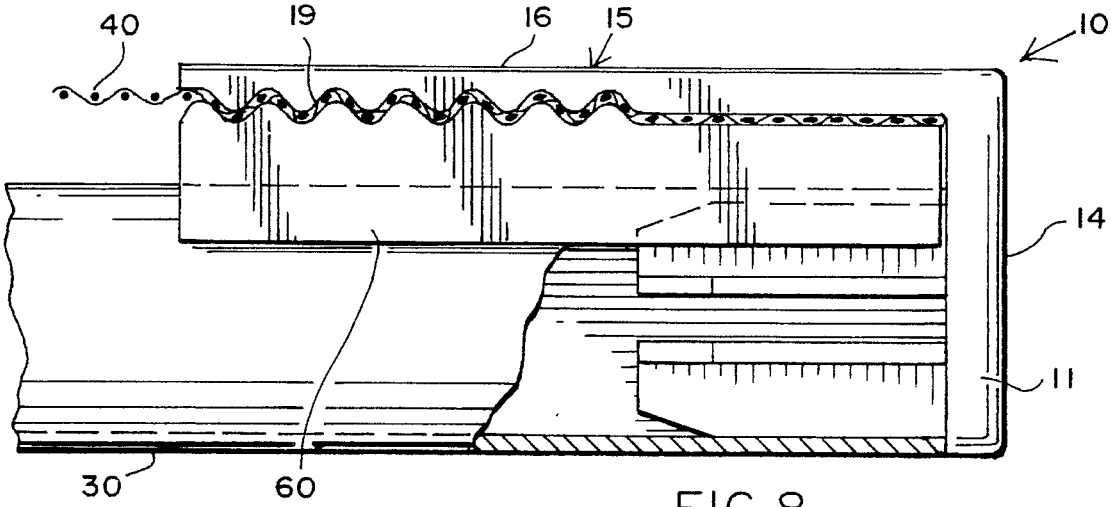
FIG. 8 is a fragmented, side elevation view of the present invention on an extension member of an umbrella frame, with tarp secured.

A detailed description of a preferred embodiment is generally shown in FIG. 8 as a clamp assembly 10 in operation. Clamp assembly 10 is comprised of two pieces.

Figure 1:
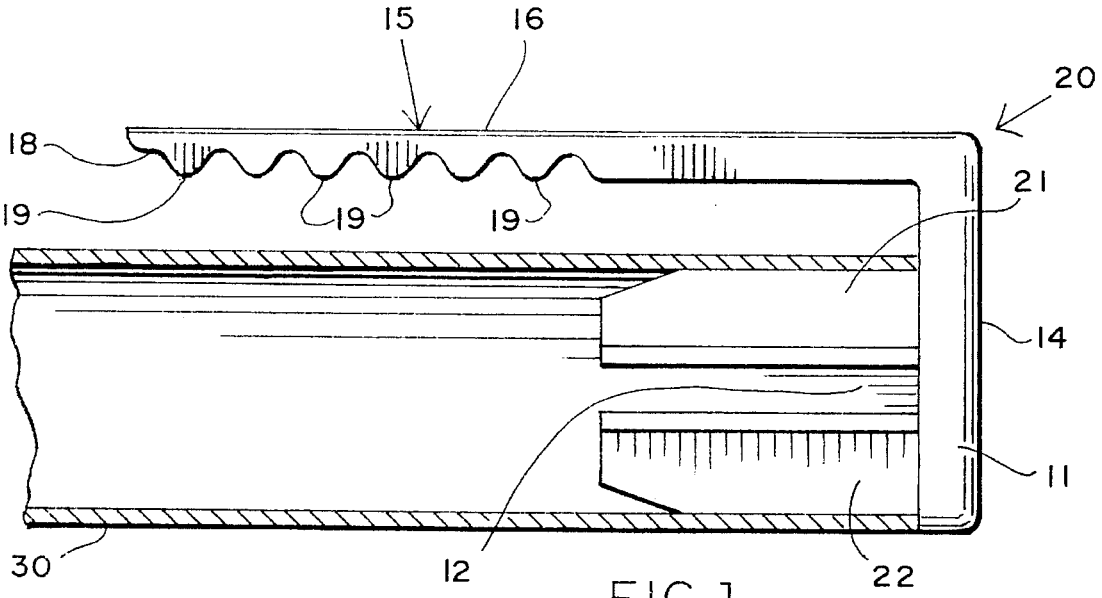
FIG. 1 is a fragmented, side elevation view depicting the top section of the present invention.

First piece top section 20 is depicted in FIG. 1. Top section 20 is comprised of a horizontal beam 11. Beam 11 is further comprised of an interior 12 and an exterior 14 thereof. The exterior 14 is also known as the end cap.

Figure 4:
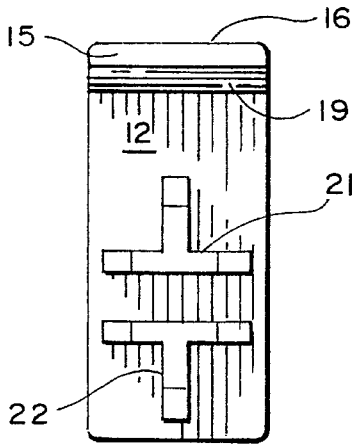
FIG. 4 is a front view of the top section of the present invention.

Protruding from the interior 12 of beam 11 are a plurality of flanges. Upper flange 15 comprises a top 16 and a bottom 18. The bottom 18 contains a plurality of undulating ribs 19. Below the upper flange 15 along interior 12 of beam 11 is a mirror image pair of lower flanges 21 and 22, respectively, generally having a capital "T" shape as seen in FIG. 4. Flanges 21 and 22 are sized and shaped to engage, for example, by pressure fit, a tubular extrusion which forms the extension member 30 of an umbrella frame. Said frame is that which holds a tarp 40 thereon shown fragmentally in FIG. 8.

Figure 2:
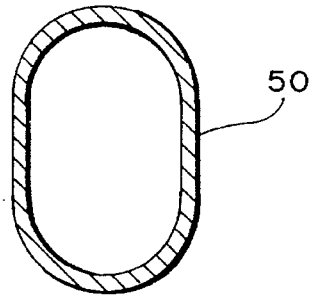
FIG. 2 is a cross section view of the tubular extrusion forming an extension member of an umbrella frame.

In the preferred embodiment, flanges 21 and 22 are sized smaller in length than upper flange 15. Flanges 21 and 22 are shaped to engage a tubular extrusion of an umbrella extension member 30 having an oval cross section shape 50 as depicted in FIG. 2. In this preferred embodiment, the end of extension member 30 is fit snugly about the flanges 21 and 22, respectively, thus being secured thereon. Though flanges 21 and 22 are shown having a "T" shape and extension member 30 is shown having a cross section oval 50 shape, any matable shape of lower flanges and extrusion cross section should be considered to be within the scope of this specification.

An oval 50 shape of the extension member 30 was chosen for its aesthetic appeal. Flanges 21 and 22 having inverted mirror "T" shapes were chosen to provide rigid, stabile and snug engagement points with extension member 30. Further, inasmuch as flange 21 is separated from flange 22, a degree of flexibility results between the two flanges when the clamp assembly 10 is made of plastic. This preferred embodiment is advantageous when fitting the extension member 30 onto said flanges 21 and 22, respectively, so as to create a more snug fit and so as to prevent damage to the extension member when compared to flanges that do not have such flexibility. When the extension member 30 is fitted entirely about flanges 21 and 22, respectively, and flush to the beam interior 12, beam exterior 14 acts as an end cap to the extension member 30.

Figure 3:
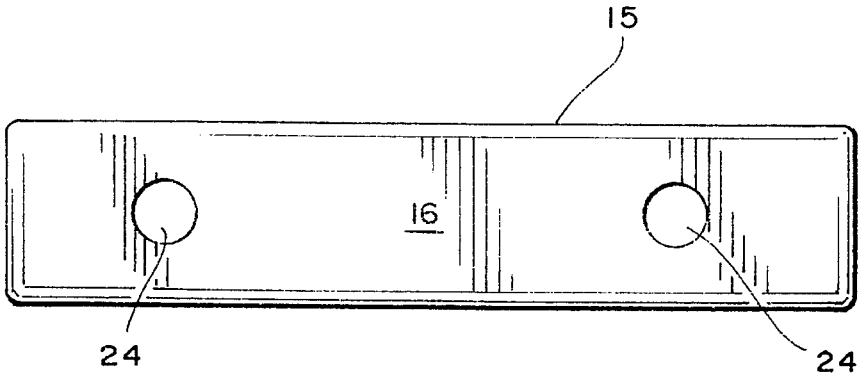
FIG. 3 is a top plan view of the top section of the present invention.

As depicted in FIG. 3, top 16 of upper flange 15 is substantially rectangular in shape. Screw holes 24 are spaced along top 16 for receiving screws, rivets, or the like to secure the top section 20 to the extension member 30 of an umbrella frame.

Figure 6:
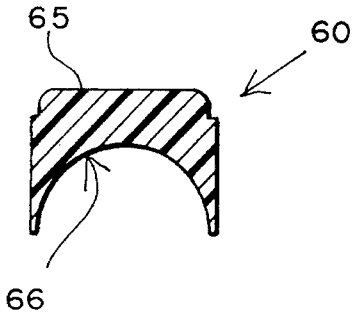
FIG. 6 is a cross section view of the bottom section of the present invention as depicted along line 6—6 of FIG. 5.
Figure 5:
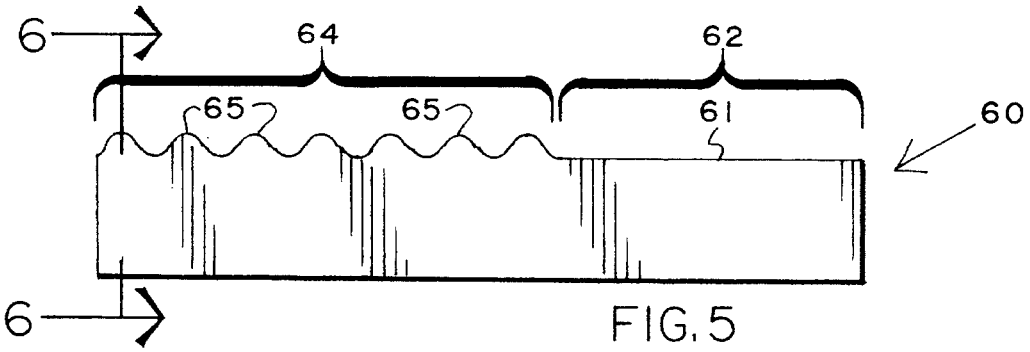
FIG. 5 is a side elevation view of the bottom section of the present invention.
Figure 7:
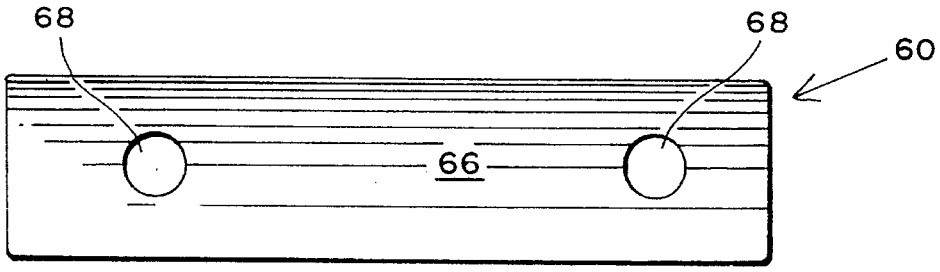
FIG. 7 is a bottom plan view of the bottom section of the present invention.

The second piece bottom section 60 is depicted alone in FIGS. 5–7. Bottom section 60 has a top 61 comprising, in part, a substantially smooth surface 62, and a substantially bumpy surface 64. The bumpy surface 64 is caused by undulating ribs 65 which are interconnectedly matable with undulating ribs 19 of top section 20.

Bottom section 60 further has an underside 66 which in the preferred embodiment, has a crescent shape to match the crescent, oval 50 shape of extension member 30 to result in a form fit. The underside 66 of course may be shaped differently to correspond with the shape of the extension member used.

As depicted in FIG. 7, bottom section 60 is substantially rectangular in shape to correspond with the substantially rectangular shape of the top 16 of upper flange 15 of top section 20. Screw holes 68 are spaced along bottom section 60, to correspond with the screw holes 24 of top 16, for receiving screws, rivets, or the like to secure the bottom section 60 to the extension member 30 of umbrella frame, and also to secure the top section 20 to the bottom section 60.

In FIG. 8, the clamp assembly 10 is shown in operation. Top section 20 of clamp assembly 10 is fitted, via flanges 21 and 22, into the end of extension member 30 until said member 30 abuts the interior 12 of beam 11. Bottom section 60 of clamp assembly 10 is then placed between the extension member 30 (shown in broke lines) and the bottom 18 of upper flange 15 so that the respective ribs, 19 and 65, are in an interconnected matable relationship and screw holes 24 and 68 are in alignment. The rim of tarp 40 is inserted between the top section 20 and bottom section 60 of clamp assembly 10 and secured to the clamp assembly 10 by screws (not shown) through screw holes 24 and 68, respectively. Pre-drilled holes (not shown) in the extension member 30 may be included to correspond with the alignment of screw holes 24 and 68.

It is intended that the description of the preferred embodiments of this invention is illustrative only. Other embodiments of the invention that are within the scope and concept of this invention are herein included within this application.

What is claimed is:

1. A two piece end cap and clamp assembly for securing the rim of an umbrella tarp to the extension member of an umbrella frame, said assembly comprising, in combination;

a first top section having a beam and a plurality of laterally extending flanges therefrom, said beam comprising an interior and an exterior such that said flanges are situated on the interior of said beam and an end cap forms the exterior thereof;

a second bottom section interconnectedly matable with said first top section and having an underside conforming to the shape of said extension member;

jaw means for retaining the said tarp within said first top section and said second bottom section, and;

means to secure said first top section and said second bottom section and further securing the underside of said bottom section to said extension member of said umbrella frame.

2. In the clamp assembly of claim 1, said jaw means comprising undulating ribs on said first top section and on said second bottom section, such that said undulating ribs are inteconnectedly matable.

3. In the clamp assembly of claim 1, said plurality of flanges numbering three, said flanges comprising an upper flange, and a pair of mirror image lower flanges comprising a "T" shape for receiving the distal end of said extension member.

4. In the clamp assembly of claim 1, said securing means comprising alignable screw holes through said first top section and said second bottom section through which screws may be inserted through said tarp and into said extension member.

* * * * *